US009424800B2

(12) United States Patent
Abe et al.

(10) Patent No.: US 9,424,800 B2
(45) Date of Patent: Aug. 23, 2016

(54) DRIVING DEVICE OF IMAGE DISPLAY MEDIUM, IMAGE DISPLAY APPARATUS, AND NON-TRANSITORY COMPUTER READABLE MEDIUM

(71) Applicant: E INK CORPORATION, Billerica, MA (US)

(72) Inventors: Masaaki Abe, Kanagawa (JP); Naoki Hiji, Kanagawa (JP); Yasufumi Suwabe, Kanagawa (JP); Yoshinori Machida, Kanagawa (JP)

(73) Assignee: E Ink Corporation, Billerica, MA (US)

( * ) Notice: Subject to any disclaimer, the term of this patent is extended or adjusted under 35 U.S.C. 154(b) by 25 days.

(21) Appl. No.: 13/954,325

(22) Filed: Jul. 30, 2013

(65) Prior Publication Data

US 2014/0210865 A1 Jul. 31, 2014

(30) Foreign Application Priority Data

Jan. 25, 2013 (JP) ..... 2013-012529

(51) Int. Cl.

| | |
|---|---|
| ***G09G 5/02*** | (2006.01) |
| ***G09G 3/34*** | (2006.01) |
| *G09G 3/20* | (2006.01) |

(52) U.S. Cl.

CPC ..... *G09G 5/02* (2013.01); *G09G 3/2014* (2013.01); *G09G 3/344* (2013.01); *G09G 3/2003* (2013.01); *G09G 2310/0245* (2013.01)

(58) Field of Classification Search

None

See application file for complete search history.

(56) References Cited

U.S. PATENT DOCUMENTS

| | | | | |
|---|---|---|---|---|
| 2005/0001812 | A1 | 1/2005 | Amundson et al. | |
| 2006/0181504 | A1 | 8/2006 | Kawai | |
| 2006/0232531 | A1 | 10/2006 | Amundson et al. | |
| 2007/0002008 | A1* | 1/2007 | Tam | G09G 3/344 345/107 |
| 2007/0247417 | A1* | 10/2007 | Miyazaki et al. | G09G 3/344 345/107 |
| 2011/0175875 | A1* | 7/2011 | Lin et al. | G09G 3/344 345/208 |
| 2011/0187756 | A1* | 8/2011 | Ono | G09G 5/10 345/690 |
| 2012/0170105 | A1* | 7/2012 | Abe et al. | G02F 1/167 359/296 |

FOREIGN PATENT DOCUMENTS

| | | |
|---|---|---|
| JP | A-2006-227249 | 8/2006 |
| JP | A-2007-249230 | 9/2007 |
| JP | A-2011-128625 | 6/2011 |

* cited by examiner

*Primary Examiner* — Jason Olson
*Assistant Examiner* — Krishna Neupane
(74) *Attorney, Agent, or Firm* — Zhen Bao

(57) ABSTRACT

Provided is a driving device of an image display medium including a voltage application unit that varies a voltage applied to a common electrode provided in one of a pair of substrates, and applies a voltage to a pixel electrode provided in the other substrate through active matrix driving, with respect to the image display medium including plural kinds of particles, and a controller that controls the voltage application unit such that a voltage is applied between the pair of substrates, and controls the voltage application unit such that a deviation time of a scanning timing generated due to the active matrix driving during transition to the steps and a potential difference between the pair of substrates in the deviation time are equal to or less than predefined threshold characteristics of the particles.

19 Claims, 19 Drawing Sheets

| APPLIED VOLTAGE [V] | RED PARTICLE THRESHOLD VALUE [ms] | CYAN PARTICLE THRESHOLD VALUE [ms] |
|---|---|---|
| 30 | 21 | 72 |
| 25 | 28 | 130 |
| 20 | 41 | 215 |
| 15 | 85 | 380 |
| 10 | 220 | 835 |

FIG. 12A

| SECOND STEP | | THIRD STEP | |
|---|---|---|---|
| FRAME TIME [ms] | V3 [V] | FRAME TIME [ms] | V5 [V] |
| 50 | 15 | 50 | -15 |
| 50 | 15 | 40 | -15 |
| 50 | 15 | 25 | -15 |
| 50 | 15 | 20 | -15 |
| 50 | 15 | 50 | -10 |
| 50 | 15 | 40 | -10 |
| 50 | 15 | 25 | -10 |
| 50 | 15 | 20 | -10 |
| 50 | 15 | 50 | -5 |
| 50 | 15 | 40 | -5 |
| 50 | 15 | 25 | -5 |
| 50 | 15 | 20 | -5 |

FIG. 12B

| SECOND STEP → THIRD STEP | | | | | |
|---|---|---|---|---|---|
| DEVIATION | | RED | | CYAN | |
| \|V3-V5\| | Δt | THRESHOLD VALUE OR LESS | DENSITY VARIATION | THRESHOLD VALUE OR LESS | DENSITY VARIATION |
| 30 | 50 | × | × | ○ | ○ |
| 30 | 40 | × | × | ○ | ○ |
| 30 | 25 | × | × | ○ | ○ |
| 30 | 20 | ○ | ○ | ○ | ○ |
| 25 | 50 | × | × | ○ | ○ |
| 25 | 40 | × | × | ○ | ○ |
| 25 | 25 | ○ | ○ | ○ | ○ |
| 25 | 20 | ○ | ○ | ○ | ○ |
| 20 | 50 | × | × | ○ | ○ |
| 20 | 40 | ○ | ○ | ○ | ○ |
| 20 | 25 | ○ | ○ | ○ | ○ |
| 20 | 20 | ○ | ○ | ○ | ○ |

FIG. 13A

| FIRST STEP | | SECOND STEP | |
|---|---|---|---|
| FRAME TIME [ms] | V1 [V] | FRAME TIME [ms] | V3 [V] |
| 100 | -15 | 100 | 15 |
| 100 | -15 | 67 | 15 |
| 100 | -15 | 50 | 15 |
| 100 | -15 | 25 | 15 |
| 100 | -15 | 100 | 10 |
| 100 | -15 | 67 | 10 |
| 100 | -15 | 50 | 10 |
| 100 | -15 | 25 | 10 |

FIG. 13B

| FIRST STEP → SECOND STEP | | | | | |
|---|---|---|---|---|---|
| DEVIATION | | RED | | CYAN | |
| \|V1-V3\| | Δt | THRESHOLD VALUE OR LESS | DENSITY VARIATION | THRESHOLD VALUE OR LESS | DENSITY VARIATION |
| 30 | 100 | × | × | × | × |
| 30 | 67 | × | × | ○ | ○ |
| 30 | 50 | × | × | ○ | ○ |
| 30 | 25 | × | × | ○ | ○ |
| 25 | 100 | × | × | ○ | ○ |
| 25 | 67 | × | × | ○ | ○ |
| 25 | 50 | × | × | ○ | ○ |
| 25 | 25 | ○ | ○ | ○ | ○ |

FIG. 14A

| THIRD STEP | | FINISH STATE | |
|---|---|---|---|
| FRAME TIME [ms] | V5 [V] | FRAME TIME [ms] | REFERENCE POTENTIAL |
| 50 | -15 | 100 | 0 |
| 50 | -15 | 67 | 0 |
| 50 | -15 | 50 | 0 |
| 50 | -15 | 25 | 0 |
| 50 | -10 | 100 | 0 |
| 50 | -10 | 67 | 0 |
| 50 | -10 | 50 | 0 |
| 50 | -10 | 25 | 0 |

FIG. 14B

| THIRD STEP → FINISH STATE | | | | | |
|---|---|---|---|---|---|
| DEVIATION | | RED | | CYAN | |
| \|V5\| | Δt | THRESHOLD VALUE OR LESS | DENSITY VARIATION | THRESHOLD VALUE OR LESS | DENSITY VARIATION |
| 15 | 100 | × | × | ○ | ○ |
| 15 | 67 | ○ | ○ | ○ | ○ |
| 15 | 50 | ○ | ○ | ○ | ○ |
| 15 | 25 | ○ | ○ | ○ | ○ |
| 10 | 100 | ○ | ○ | ○ | ○ |
| 10 | 67 | ○ | ○ | ○ | ○ |
| 10 | 50 | ○ | ○ | ○ | ○ |
| 10 | 25 | ○ | ○ | ○ | ○ |

FIG. 15A

| SECOND STEP | | INTERMEDIATE FRAME | | THIRD STEP | |
|---|---|---|---|---|---|
| FRAME TIME [ms] | V3 [V] | FRAME TIME [ms] | POTENTIAL [V] | FRAME TIME [ms] | V5 [V] |
| 50 | 15 | 50 | 0 | 50 | −15 |
| 50 | 15 | 50 | 0 | 40 | −15 |
| 50 | 15 | 50 | 0 | 25 | −15 |
| 50 | 15 | 50 | 0 | 20 | −15 |
| 50 | 15 | 40 | 0 | 40 | −15 |
| 50 | 15 | 25 | 0 | 25 | −15 |
| 50 | 15 | 20 | 0 | 20 | −15 |

FIG. 15B

| SECOND STEP → INTERMEDIATE FRAME | | | | INTERMEDIATE FRAME → THIRD STEP | | | | SECOND STEP → THIRD STEP | | | | | |
|---|---|---|---|---|---|---|---|---|---|---|---|---|---|
| DEVIATION | | RED | CYAN | DEVIATION | | RED | CYAN | DEVIATION | | RED | | CYAN | |
| \|V3\| | Δt1 | THRESHOLD VALUE OR LESS | THRESHOLD VALUE OR LESS | \|V5\| | Δt2 | THRESHOLD VALUE OR LESS | THRESHOLD VALUE OR LESS | \|V3-V5\|/2 | Δt1+Δt2 | THRESHOLD VALUE OR LESS | DENSITY VARIATION | THRESHOLD VALUE OR LESS | DENSITY VARIATION |
| 15 | 50 | ○ | ○ | 15 | 50 | ○ | ○ | 15 | 100 | × | × | ○ | ○ |
| 15 | 50 | ○ | ○ | 15 | 40 | ○ | ○ | 15 | 90 | × | × | ○ | ○ |
| 15 | 50 | ○ | ○ | 15 | 25 | ○ | ○ | 15 | 75 | ○ | ○ | ○ | ○ |
| 15 | 50 | ○ | ○ | 15 | 20 | ○ | ○ | 15 | 70 | ○ | ○ | ○ | ○ |
| 15 | 40 | ○ | ○ | 15 | 40 | ○ | ○ | 15 | 80 | ○ | ○ | ○ | ○ |
| 15 | 25 | ○ | ○ | 15 | 25 | ○ | ○ | 15 | 50 | ○ | ○ | ○ | ○ |
| 15 | 20 | ○ | ○ | 15 | 20 | ○ | ○ | 15 | 40 | ○ | ○ | ○ | ○ |

DRIVING DEVICE OF IMAGE DISPLAY MEDIUM, IMAGE DISPLAY APPARATUS, AND NON-TRANSITORY COMPUTER READABLE MEDIUM

CROSS-REFERENCE TO RELATED APPLICATIONS

This application is based on and claims priority under 35 USC 119 from Japanese Patent Application No. 2013-012529 filed Jan. 25, 2013.

BACKGROUND (i) Technical Field

The present invention relates to a driving device of an image display medium, an image display apparatus, and a non-transitory computer readable medium.

(ii) Related Art

In the related art, as an image display medium which has a memory property and may be repeatedly updated, an image display medium using a colored particle is known. The image display medium includes, for example, a pair of substrates and particle groups which are sealed between substrates so as to be movable between the substrates due to an electric field applied to the pair of substrates and have different colors and charging characteristics.

In this image display medium, particles are moved by applying a voltage corresponding to an image between a pair of substrates, and the image is displayed using colors of particles as a contrast.

SUMMARY

According to an aspect of the present invention, there is provided a driving device of an image display medium including:

a voltage application unit that varies a voltage applied to a common electrode provided in one of a pair of substrates, and applies a voltage to a pixel electrode provided in the other substrate through active matrix driving, with respect to the image display medium including plural kinds of particles which are sealed between the pair of substrates at least one of which is transparent, are colored in different colors for each kind, and have different threshold characteristics of a voltage required to leave the substrate from a state of being adhered to the substrate for each kind, and displaying an image based on image information; and a controller that controls the voltage application unit such that a voltage is applied between the pair of substrates through plural steps in which voltages for controlling a particle concentration are sequentially applied between the pair of substrates in order in which the threshold characteristics are large, and controls the voltage application unit such that a deviation time of a scanning timing generated due to the active matrix driving during transition to the steps and a potential difference between the pair of substrates in the deviation time are equal to or less than predefined threshold characteristics of the particles.

BRIEF DESCRIPTION OF THE DRAWINGS

Exemplary embodiments of the present invention will be described in detail based on the following figures, wherein:

FIGS. 4A and 4B are diagrams illustrating a fundamental driving method of the image display medium according to the present exemplary embodiment, in which FIG. 4A shows voltages applied to respective electrodes, and FIG. 4B shows electric fields between substrates;

FIG. 12A is a table illustrating driving of a first example;

FIG. 12B is a table illustrating an evaluation result of the driving of the first example;

FIG. 13A is a table illustrating driving of a second example;

FIG. 13B is a table illustrating an evaluation result of the driving of the second example;

FIG. 14A is a table illustrating driving of a third example;

FIG. 14B is a table illustrating an evaluation result of the driving of the third example;

FIG. 15A is a table illustrating driving of a fourth example; and

FIG. 15B is a table illustrating an evaluation result of the driving of the fourth example.

DETAILED DESCRIPTION

Figure 1A:
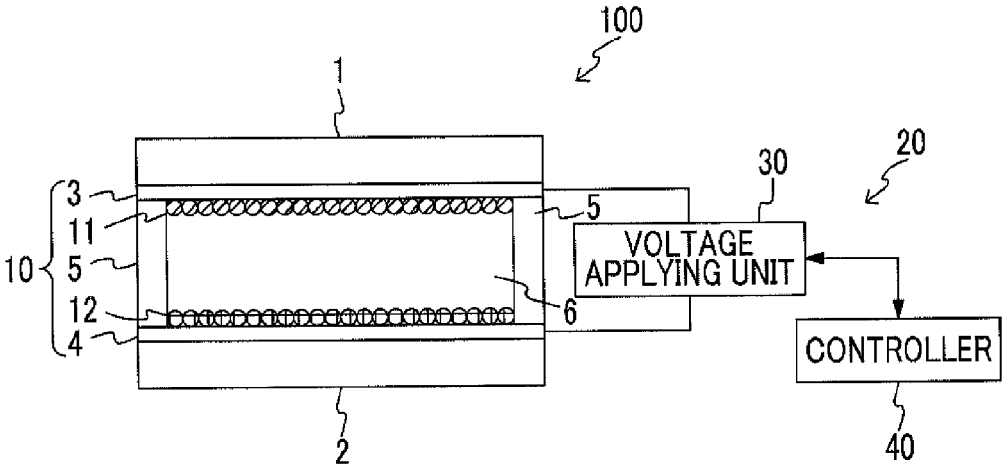
FIG. 1A is a schematic diagram of an image display apparatus according to the present exemplary embodiment of the invention.

Hereinafter, exemplary embodiments of the invention will be described with reference to the drawings. The members having the same operation or function are given the same reference numerals throughout all the drawings, and repeated description is omitted in some cases. In addition, for simplicity of description, the exemplary embodiment will be described with reference to the drawings in which attention is paid to an appropriate single cell. Further, an adhesive force herein indicates a force which is required for a particle to maintain a state of being adhered to a substrate.

FIG. 1A schematically shows an image display apparatus according to the present exemplary embodiment. The image display apparatus 100 includes an image display medium 10 and a driving device 20 which drives the image display medium 10. The driving device 20 includes a voltage applying unit 30 which applies a voltage between a display side electrode 3 and a rear surface side electrode 4 of the image display medium 10, and a controller 40 which controls the voltage applying unit 30 according to image information of an image displayed on the image display medium 10.

The image display medium 10 has a pair of substrates in which a transparent display substrate 1 which is an image display surface and a rear surface substrate 2 which is a non-display surface are disposed so as to be opposite to each other with a gap.

A spacer 5 is provided which holds the substrates 1 and 2 in a predefined gap and partitions a space between the substrates into plural cells.

The cell indicates a region surrounded by the rear surface substrate 2 provided with the rear surface side electrode 4, the display substrate 1 provided with the display side electrode 3, and the spacer 5. In the cell, for example, a dispersion medium 6 constituted by an insulating liquid, and a first particle group 11 and a second particle group 12 dispersed in the dispersion medium 6 are sealed. In addition, the first particle group 11 is a particle group of particles A described later, and the second particle group 12 is a particle group of particles B described later.

The first particle group 11 and the second particle group 12 are colored in different colors, have different adhesive forces for maintaining a state of being adhered to the substrates, and thus have different voltages which are required to leave the substrates in a state of being adhered to the substrates by an electric field between the substrates. Therefore, the first particle group 11 and the second particle group 12 have characteristics of migrating independently by controlling a voltage applied between a pair of electrodes 3 and 4. More specifically, when a force applied in a direction in which the particles leave the substrate becomes equal to or more than the adhesive force due to an electric field generated by applying a voltage, the particles leave the substrate and go toward the other substrate. A voltage at which the particles start to move when the force generated by an electric field is in equilibrium with the adhesive force is referred to a threshold voltage. In the present exemplary embodiment, even after the first particle group 11 and the second particle group 12 are moved, and then application of a voltage stops after an image is displayed, the particles are still adhered to the substrate by a van der Waals force, an image force, an electrostatic attraction, and the like, and thus the image display is maintained. Such an image force, an electrostatic attraction, a van der Waals force, and the like may be adjusted so as to control the adhesive force of the particles, and, as means thereof, for example, a charge amount of particles, a particle diameter, an electric charge density, a dielectric constant, a surface shape, surface energy, a composition or a density of a dispersant, and the like, may be respectively appropriately adjusted. Further, in addition to the first particle group 11 and the second particle group 12, a white particle group which is colored white may be included. In this case, the white particle group may be a floating particle group which has a charge amount smaller than the first particle group 11 and the second particle group 12, and is a particle group which is not moved to either of the electrode sides even if a voltage for moving the first particle group 11 and the second particle group 12 to either of the electrode sides is applied between the electrodes. Alternatively, two kinds of particle groups including the first particle group 11 or the second particle group 12 and the floating particle group may be configured. Alternatively, white different from colors of the migrating particles may be displayed by mixing the dispersion medium with a colorant.

The driving device 20 (the voltage applying unit 30 and the controller 40) controls a voltage applied between the display side electrode 3 and the rear surface side electrode 4 of the image display medium 10 according to a color to be displayed such that the particle groups 11 and 12 are made to migrate and are thus pulled to either of the display substrate 1 and the rear surface substrate 2 depending on a charged polarity of each of the two groups.

The voltage applying unit 30 is electrically connected to the display side electrode 3 and the rear surface side electrode 4. In addition, the voltage applying unit 30 is connected to the controller 40 such that a signal is sent and received therebetween.

Figure 1B:
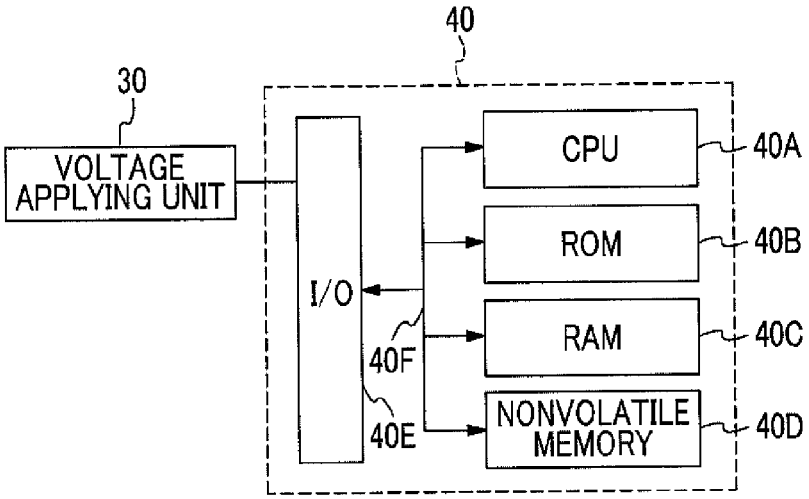
FIG. 1B is a block diagram illustrating a configuration of a controller according to the present exemplary embodiment of the invention.

The controller 40 includes, for example, a computer 40 as shown in FIG. 1B. The computer 40 includes, for example, a Central Processing Unit (CPU) 40A, a Read Only Memory (ROM) 40B, a Random Access Memory (RAM) 40C, a nonvolatile memory 40D, and an input and output interface (I/O) 40E, which are connected to each other via a bus 40F, and the I/O 40E is connected to the voltage applying unit 30. In this case, a program causing the computer 40 to execute a process for instructing the voltage applying unit 30 to apply a voltage necessary for display of each color is written in, for example, the nonvolatile memory 40D, and the CPU 40A reads and executes the program. In addition, the program may be provided using a recording medium such as a CD-ROM.

Figure 2:
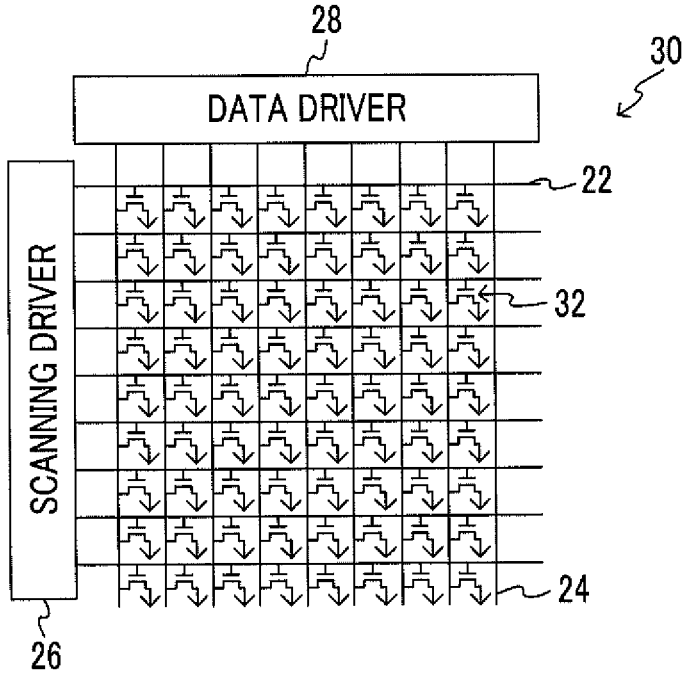
FIG. 2 is a diagram illustrating a schematic configuration of a voltage applying unit of the image display apparatus according to the present exemplary embodiment.

The voltage applying unit 30 is a voltage applying device for applying a voltage to the display side electrode 3 and the rear surface side electrode 4, and applies a voltage responding to the control of the controller 40 to the display side electrode 3 and the rear surface side electrode 4. The voltage applying unit 30 employs an active matrix type in the present exemplary embodiment. FIG. 2 is a diagram illustrating a schematic configuration of the voltage applying unit 30 employing the active matrix type according to the present exemplary embodiment.

In other words, the voltage applying unit 30 according to the present exemplary embodiment includes plural scanning lines 22 and plural signal lines 24 arranged in a matrix as shown in FIG. 2. The scanning lines 22 are connected to a scanning driver 26, and the signal lines 24 are connected to a data driver 28.

In addition, a thin film transistor (TFT) 32 and an electrode (the rear surface side electrode 4 in the present exemplary embodiment) are provided at each of intersections of the scanning lines 22 and the signal lines 24. Specifically, the scanning lines 22 are connected to gates of the thin film transistors, the rear surface side electrode 4 is connected to drains thereof, and the data driver 28 is connected to sources thereof. Further, the colored particles (the first particle group 11 and the second particle group 12) are sealed between the rear surface side electrode 4 and the display side electrode 3.

In other words, the thin film transistors 32 arranged in a matrix are sequentially selected by controlling the scanning driver 26 and the data driver 28, and a voltage corresponding to image information is applied to the rear surface side electrode 4 so as to display an image. In addition, in a case where the magnitude of a voltage is changed, a source voltage supplied from the data driver 28 is changed so as to change the magnitude of a voltage applied between the substrates.

Further, in the present exemplary embodiment, when the particle groups (the first particle group 11 and the second particle group 12) having different forces (adhesive forces) which are required to maintain a state of being adhered to the substrates are driven, movements of the particle groups are controlled by controlling a voltage applied between the substrates as described above. In addition, in the present exemplary embodiment, an electric field, which moves the particles relative to the adhesive force, is set as a threshold characteristic, and the control of an applied voltage includes, for example, control of the magnitude of a voltage or an application time of a voltage.

Figure 3:
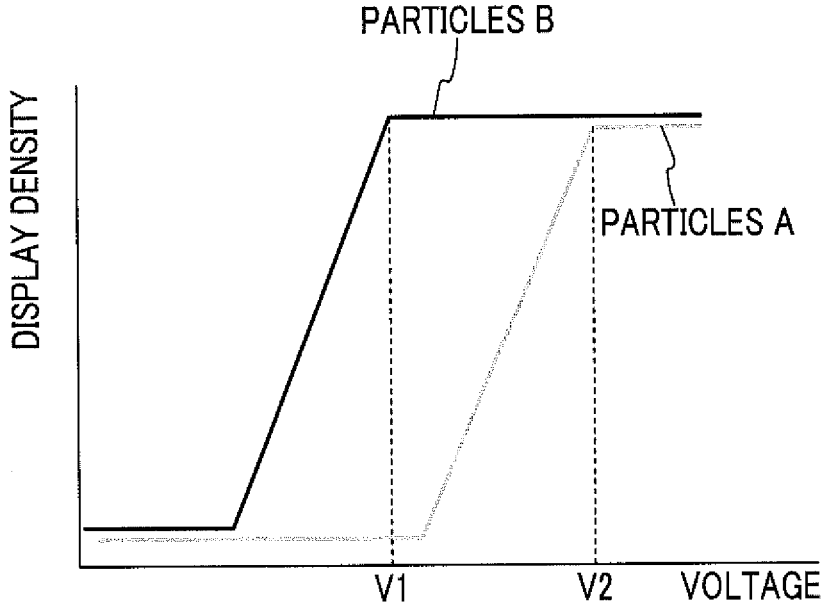
FIG. 3 is a diagram illustrating an example of motion threshold characteristics of particles A and particles B.

In the present exemplary embodiment, for example, as in particles A and particles B of FIG. 3, the threshold characteristics are different for the respective particles, and a voltage applied between the substrates is controlled so as to control a movement of the particles. In addition, in the present exemplary embodiment, the particles A are set as the first particle group 11, and the particles B are set as the second particle group 12.

Specifically, a voltage for moving a particle having the largest threshold characteristic is applied so as to move all the particles to either one of the substrates (reset driving), and, then, a voltage applied between the substrates is controlled such that a particle concentration is controlled in order from a particle having a large motion threshold characteristic.

For example, in the example shown in FIG. 3, in a case where a color of the particles B is displayed, a voltage –V2 is applied so as to move both of the particles to the rear surface substrate 2 side, then, a voltage V1 is applied so as to move only the particles B to the display substrate 1 side, thereby displaying the color of the particles B.

In addition, in a case where a color of the particles A is displayed, the voltage V2 is applied so as to move both of the particles to the display substrate 1 side, then, the voltage –V1 is applied so as to move only the particles B to the rear surface substrate 2 side, thereby displaying the color of the particles A.

However, an attraction between particle substrates or particles depends on a distance between the particle substrates or a distance between the particles. Therefore, even if an external force (electric field intensity) which disconnects the attraction is given, the particles are still adhered and are not separated if the external force disappears before the particles reach out of a range of the attraction. In other words, time for moving the particles out of a range of the attraction is necessary, and the threshold characteristics include this time (separation time). In the present exemplary embodiment, a voltage and time in which an optical reflectance varies by 10% are set as threshold characteristics. In addition, the optical reflectance uses a relative variation when two reset states (states in which the number of measured particles is the largest and the smallest) are 0 to 100% at a reflectance of a feature wavelength (typically, an absorption wavelength) of measured particles. Further, a migration time (speed) of particles is a migration time when the attraction is not present (small) and is different from the separation time. Furthermore, as in the present exemplary embodiment, in a case of the particles having the threshold characteristics, the separation time is greater than the migration (movement) time.

Here, as in the present exemplary embodiment, in the image display medium using plural kinds of particles having different threshold characteristics, it is necessary to increase an applied electric field in order to improve responsiveness of the particles, and one of methods for increasing an applied electric field is a driving method in which a potential of the common electrode is variable.

The present exemplary embodiment employs the driving method in which a potential of the common electrode is variable, and a voltage applied to the display side electrode 3 which is a common electrode is varied. Thus, it is possible to increase a voltage applied between the substrates and to thereby improve responsiveness of the particles. In other words, the voltage applying unit 30 also has a function of controlling a voltage applied to the display side electrode 3 which is a common electrode.

Here, a fundamental driving method in the image display apparatus according to the present exemplary embodiment will be described with reference to FIGS. 4A and 4B. In addition, in the following, the display side electrode 3 is referred to as a common electrode, and the rear surface side electrode 4 is referred to as a pixel electrode.

Figure 4A:
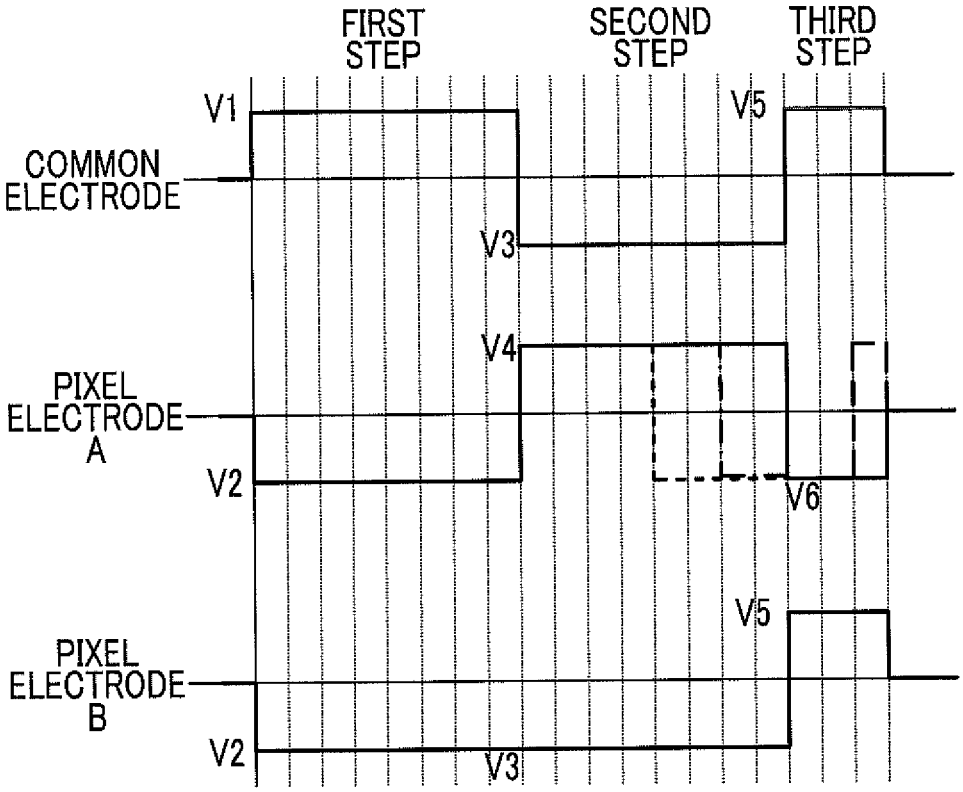

In the present exemplary embodiment, as shown in FIG. 4A, an image is displayed, for example, through three steps including first to third steps.

Reset driving for moving all the particles to one substrate side is performed in the first step, a voltage for controlling a particle concentration of the first particle group 11 having larger threshold characteristics is applied in the second step, and a voltage for controlling a particle concentration of the second particle group 12 having smaller threshold characteristics is applied in the third step.

For example, in a pixel A of FIG. 4A, an image is displayed through the first step in which the voltage V1 is applied to the common electrode, and the voltage V2 is applied to plural pixel electrodes, the second step in which a voltage V3 is applied to the common electrode, and a voltage V4 is applied to at least some of the plural pixel electrodes, and the third step in which a voltage V5 is applied to the common electrode, and a voltage V6 is applied to at least some of the plural pixel electrodes. Here, in the second step or the third step, a voltage application time is varied so as to perform tone display as indicated by the dotted line or the dot chain line with respect to a voltage applied according to a displayed tone.

In addition, in a pixel B, the voltage V2 is applied to the plural pixel electrodes at the timing when the voltage V1 is applied to the common electrode in the first step, and the voltage V3 is applied to the plural pixel electrodes at the timing when the voltage V3 is applied to the common electrode in the second step.

Figure 4B:
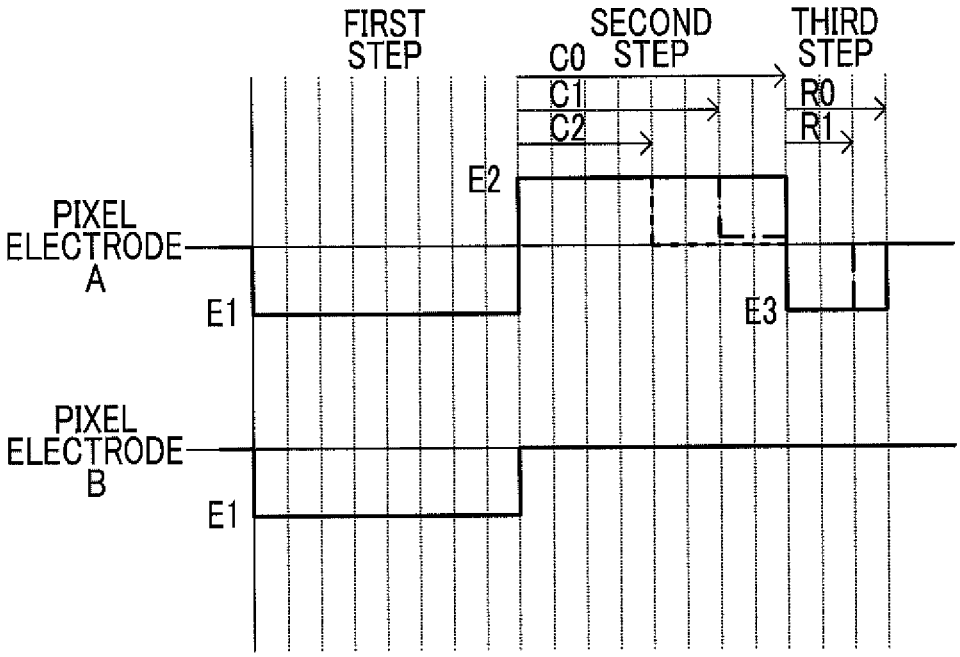

In this case, electric fields which are finally applied to the pixel A are an electric field E1 in the first step, an electric field E2 in the second step, and an electric field E3 in the third step, as shown in FIG. 4B. In addition, the electric field E2 and the electric field E3 vary depending on the voltage application time in the second and third steps, and thereby an image is displayed in concentrations of tones C0 to C2, and tones R0 and R1, respectively.

On the other hand, in the pixel B, since the electric field E1 is applied in the first step, and the voltage with the same voltage variation as the voltage variation of the common electrode is applied in the second step and the third step, an electric field is not generated, and thus the particles are not moved.

In the image display apparatus 100 according to the present exemplary embodiment, as described above, voltages applied to the common electrode and the pixel electrode are controlled so as to display an image, and a voltage applied to the common electrode is also varied so as to improve a response speed of the particles.

Here, as in the present exemplary embodiment, timings when voltages are applied to the pixels are deviated due to deviation of scanning timings of the scanning lines which are sequentially scanned in the active matrix driving. If a voltage of the common electrode is fixed, even if the scanning timings are deviated, an electric field which is finally applied to the pixels does not vary.

However, as in the present exemplary embodiment, in a case where a voltage applied to the common electrode is variable, when a timing of a potential variation of the common electrode is deviated from a timing of a potential variation of the pixel electrode, an unintended electric field is applied to the pixels.

Figure 5:
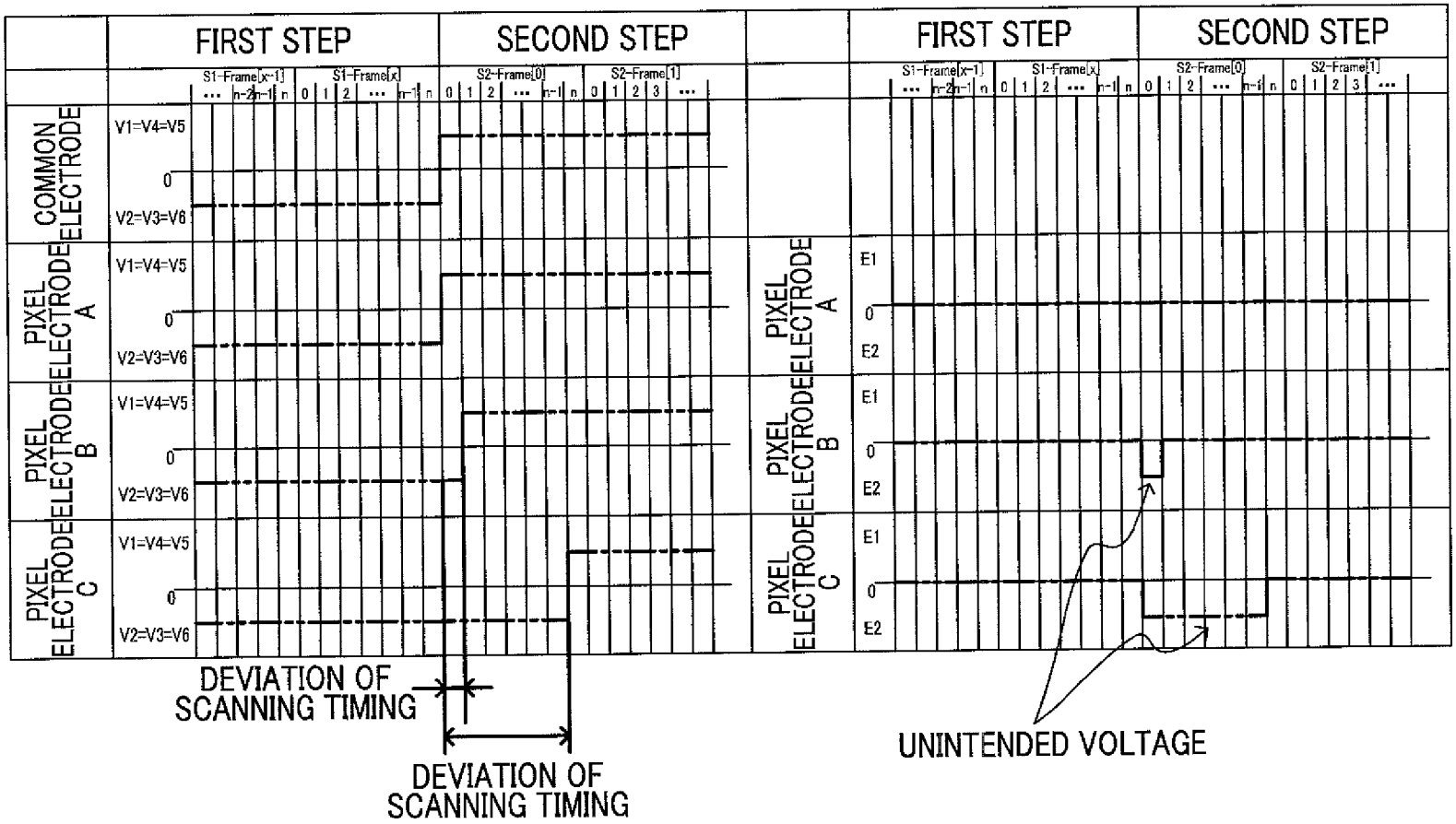
FIG. 5 is a diagram illustrating voltage applied to the respective electrodes and electric fields between the substrates during transition from a first step to a second step.
Figure 6:
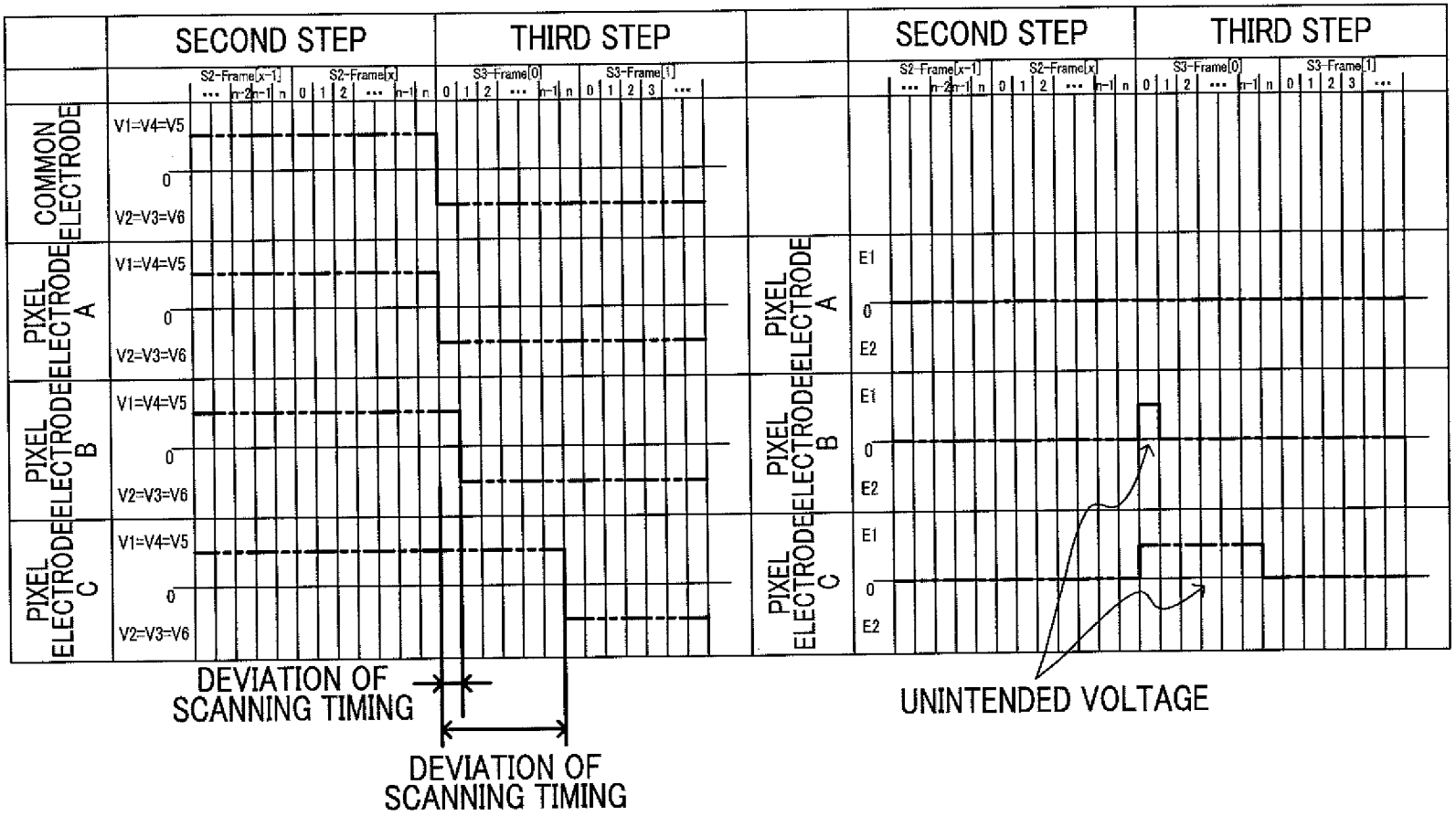
FIG. 6 is a diagram illustrating voltage applied to the respective electrodes and electric fields between the substrates during transition from the second step to a third step.
Figure 7:
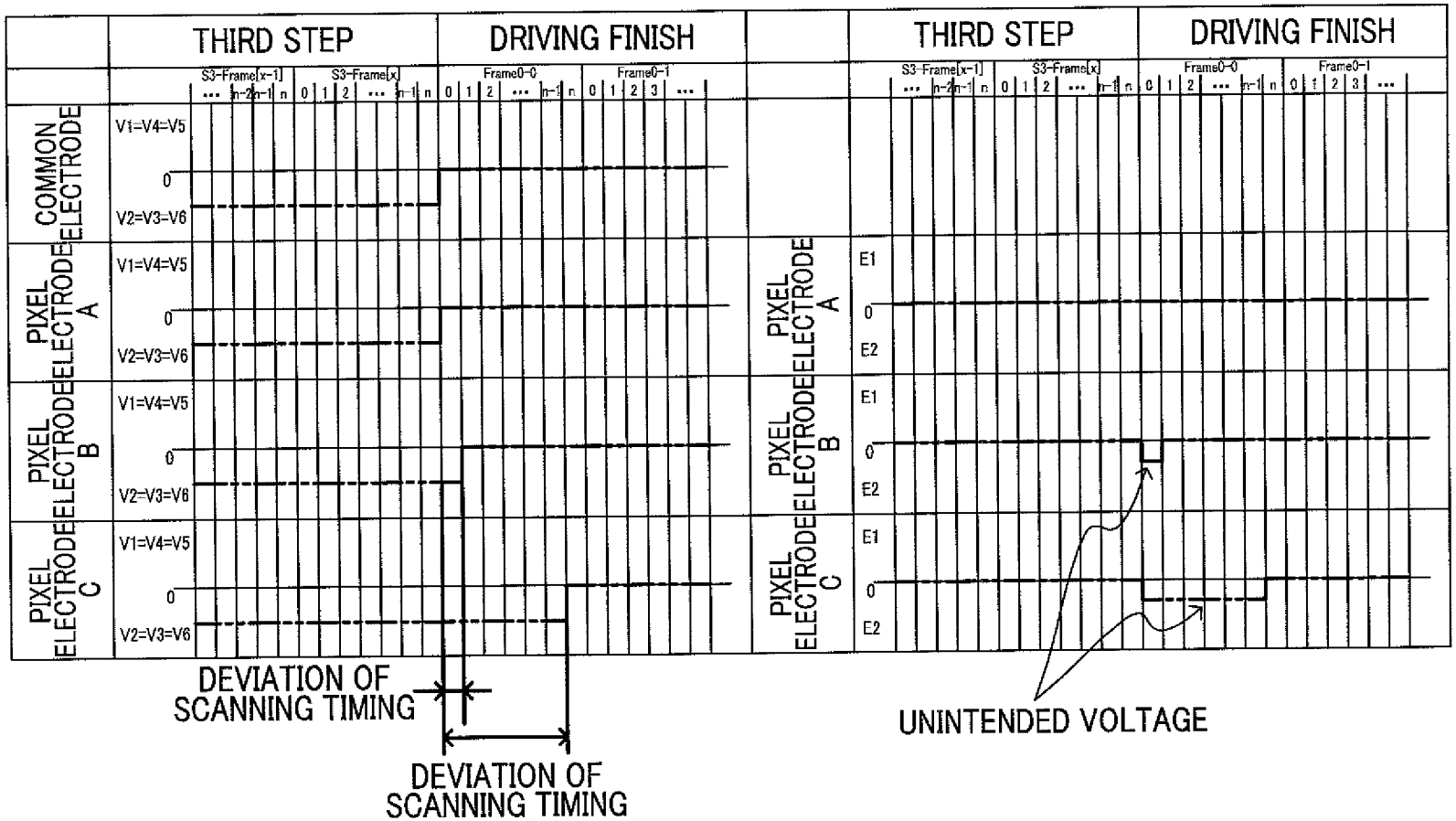
FIG. 7 is a diagram illustrating voltage applied to the respective electrodes and electric fields between the substrates during transition from the third step to driving finish.

For example, in a case where an electric field is not applied to the pixels, the common electrode and the pixel electrode are required to be set to the same potential, but, assuming that potential variation timings of the first scanning line and the common electrode match each other, a timing of a potential variation of the pixel electrode connected to the subsequent second scanning line is deviated by a scanning time of one scanning line. Thus, as shown in FIGS. 5 to 7, an unintended electric field is applied between the substrates by the deviation time, and thereby a color to be displayed may not be displayed. In other words, as shown in FIGS. 5 to 7, since sequential scanning is performed from the pixel A, an unintended voltage is applied due to the deviation of the scanning timings in the pixels B and C. In addition, FIG. 5 shows voltages applied to the common electrode and the pixel electrode during transition from the first step to the second step and electric fields between the substrates at this time, FIG. 6 shows voltages applied to the common electrode and the pixel electrode during transition from the second step to the third step and electric fields between the substrates at this time, and FIG. 7 shows voltages applied to the common electrode and the pixel electrode during transition from the third step to driving finish and electric fields between the substrates at this time.

Specifically, in the transition from the first step to the second step (FIG. 5), an unintended voltage (unnecessary voltage) is a voltage |V1-V3|, and if this unnecessary voltage exceeds the threshold characteristics of the first particle group 11, a concentration of the first particle group 11 varies before driving in the second step, thus a mixed color occurs, and thereby favorable display is unable to be performed. In addition, since the second particle group 12 is controlled in the second step, the second particle group 12 is not necessarily required to be equal to or less than a threshold value.

Further, similarly, in the transition from the second step to the third step (FIG. 6), an unnecessary voltage is a voltage |V3-V5|, and if this unnecessary voltage exceeds the threshold value of the second particle group 12, a concentration of the second particle group 12 varies before driving in the third step, thus a mixed color occurs, and thereby favorable display is unable to be performed.

Similarly, in the transition from the third step to the driving finish (FIG. 7), an unnecessary voltage is a voltage |V5-reference potential|, and if this unnecessary voltage exceeds the threshold characteristics of the second particle group 12, a concentration of the second particle group 12 varies at the time of the finish, and thereby favorable display is unable to be performed.

Figure 8A:
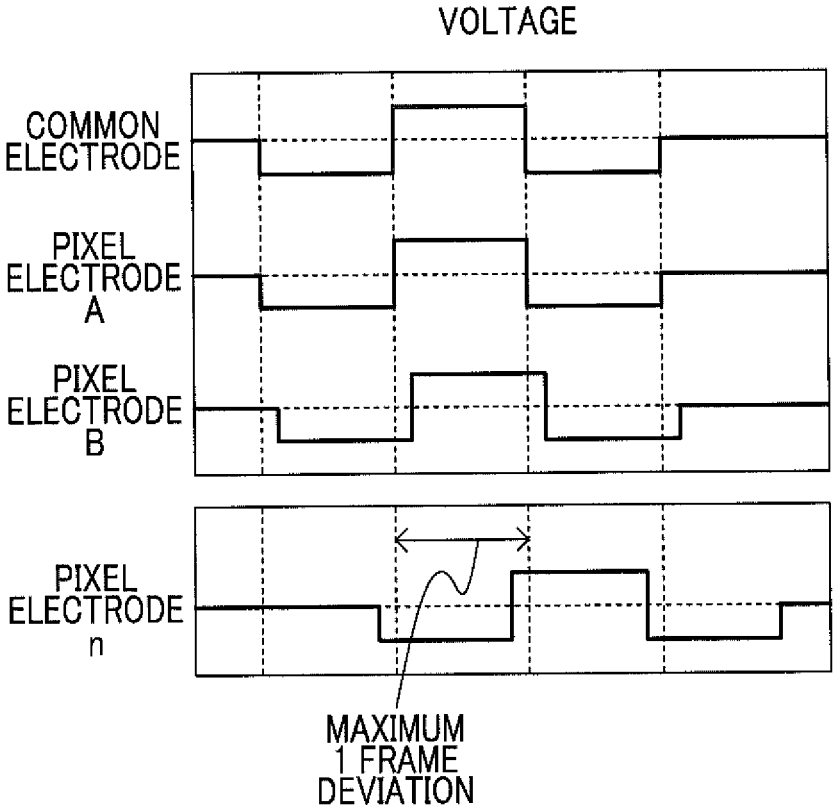
FIGS. 8A and 8B are diagrams illustrating a deviation time of scanning timings.
Figure 8B:
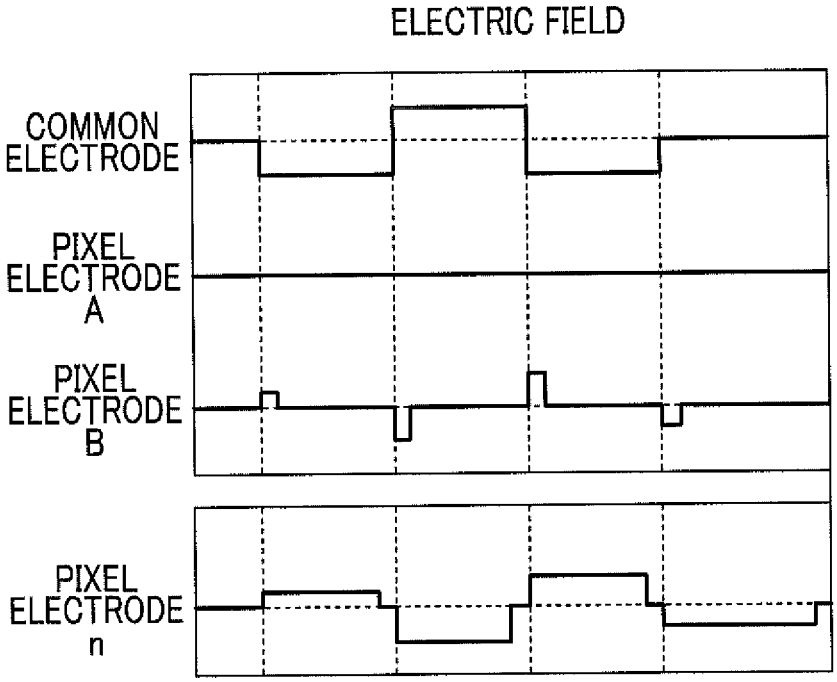

On the other hand, as shown in FIGS. 8A and 8B, a deviation time of the scanning timing is approximately one frame at most since sequential scanning is performed such as the pixel electrode A, the pixel electrode B, . . . , and the pixel electrode n. When a potential difference between the common electrode and the pixel electrode when deviation occurs is equal to or less than the threshold characteristics in which the particles are moved in the deviation time of approximately one frame, the particles are not moved, and stable display may be performed. In addition, the one frame time typically indicates the time for scanning all the scanning lines.

Therefore, in the present exemplary embodiment, a deviation time generated due to deviation of the scanning timing and a potential difference between the common electrode and the pixel electrode during step transition are controlled so as to be equal to or less than predefined threshold characteristics of the particles. In other words, a potential difference between the common electrode and the pixel electrode during step transition in a deviation time generated due to deviation of the scanning timing is controlled so as to be equal to or less than the predefined threshold characteristics of the particles. Alternatively, a deviation time generated due to deviation of the scanning timing in a potential difference between the common electrode and the pixel electrode when step displacement is performed is controlled so as to be equal to or less than the predefined threshold characteristics of the particles.

Specifically, a voltage difference between the voltage V3 and the voltage V5 (voltage difference between V4 and V6) in a deviation time between potential changing timing of the common electrode and a potential changing timing of the pixel electrode during transition from the second step to the third step is set to be equal to or less than the threshold characteristics of the second particle group 12. Thus, an unnecessary concentration variation of the second particle group 12 during the transition to the third step is suppressed.

In addition, in order to perform the above-described operation, the frame time of the second step is set to be greater than the frame time of the third step, or |voltage V3-voltage V4| is set to be greater than |voltage V5-voltage V6|. In other words, the voltage applying unit 30 is controlled such that the frame time of each step gradually decreases, or the voltage applying unit 30 is controlled such that a potential difference between the substrates during transition to each step gradually decreases.

Further, preferably, a voltage difference between the voltage V1 and the voltage V3 (voltage difference between V2 and V4) in a deviation time between potential changing timing of the common electrode and a potential changing timing of the pixel electrode during transition from the first step to the second step is set to be equal to or less than the threshold characteristics of the first particle group 11. Thus, an unnecessary concentration variation of the first particle group 11 during the transition to the second step is suppressed.

Furthermore, preferably, a voltage difference between the voltage V1 and the voltage V3 (voltage difference between V2 and V4) in a deviation time between potential changing timing of the common electrode and a potential changing timing of the pixel electrode during transition from the first step to the second step is set to be equal to or less than the threshold characteristics of the second particle group 12. Thus, unnecessary concentration variations of the first particle group 11 and the second particle group 12 during the transition to the second step and during the transition to the third step are suppressed.

In order that a deviation time of the scanning timing and an unnecessary potential in this deviation time are not to exceed the threshold characteristics of the particles, for example, a voltage set value may be set when a voltage applied to the common electrode is varied, or an application time may be set, such that a potential difference between the common electrode and the pixel electrode when deviation occurs in a deviation time generated due to the deviation of the scanning timing is equal to or less than the threshold characteristics. As an example, when a voltage applied to the common electrode is displaced, an absolute value of an unnecessary potential is able to be reduced by varying a voltage applied to the common electrode in stages, and thus the voltage applied to the common electrode is controlled so as to be suppressed to the threshold value or less in the overall displacement.

Figure 9:
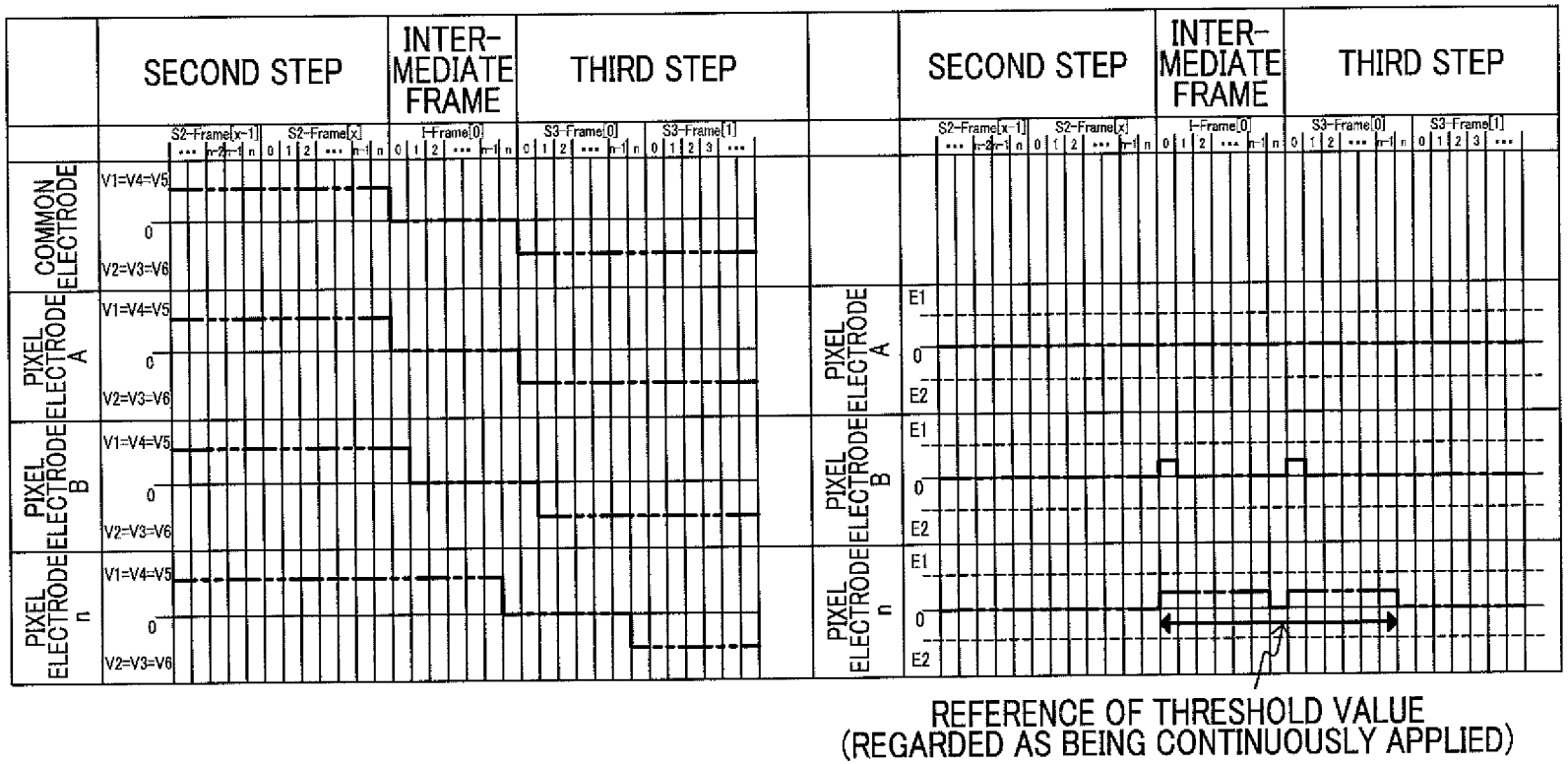
FIG. 9 is a diagram illustrating voltages applied to the respective electrodes when an intermediate potential is applied between the steps and electric fields between the substrates at this time.

In addition, in a case where transition occurs from the first step to the second step, as shown in FIG. 9, the common electrode and the pixel electrode may be temporarily set to an intermediate potential between the voltage V1 and the voltage V2. Further, similarly, in a case where transition occurs from the second step to the third step, an intermediate potential between the voltage V3 and the voltage V4 may be set. This intermediate potential may be any voltage as long as it is located between the voltage V1 and the voltage V2, or between the voltage V3 and the voltage V4. In this way, an unnecessary potential is reduced by setting the intermediate potential. For example, in a case where an intermediate potential is passed for one frame, as compared with a case where the common electrode directly transitions from the voltage V3 to the voltage V5, the time when an unnecessary electric field is applied becomes doubled, but the magnitude of an unnecessary electric field generated due to deviation of the scanning timing is reduced. In addition, the smaller the electric field, the longer the threshold time, and thus to perform the transition in this way reduces influence of an unnecessary electric field. Further, in the pixel n of FIG. 9, an unnecessary electric field becomes 0 for a moment, but this is performed for a very short time of approximately one scanning time, and thus an unnecessary electric field is regarded as being continuously applied to the particles. Therefore, a threshold value is determined assuming that an unnecessary electric field is applied for the time required for the common electrode to transition from the voltage V3 to the voltage V5.

In addition, after the third step, the common electrode and the pixel electrode are set to a reference potential, and both of a potential difference between the voltage V5 and the reference potential and a potential difference between the voltage V6 and the reference potential in a deviation time between a potential changing timing of the common electrode and a potential changing timing of the pixel electrode at that time may be set to be equal to or less than a threshold value of the second particle group 12.

Next, the image display apparatus 100 according to the present exemplary embodiment will be described using specific examples.

Hereinafter, a description will be made of examples using an image display medium in which cyan particles which are charged to a positive polarity and are colored cyan as the first particle group 11 and red particles which are charged to a positive polarity and are colored red as the second particle group 12 are sealed between the substrates, and white particles which have a smaller charge amount and lower migration speed than the cyan particles and the red particles and are colored white are also sealed between the substrates.

In addition, the cyan particles have larger threshold characteristics than the red particles. In other words, in the following examples, a description will be made of an example in which the cyan particles are set as the first particle group 11, and the red particles are set as the second particle group 12.

Figures 10, 11:
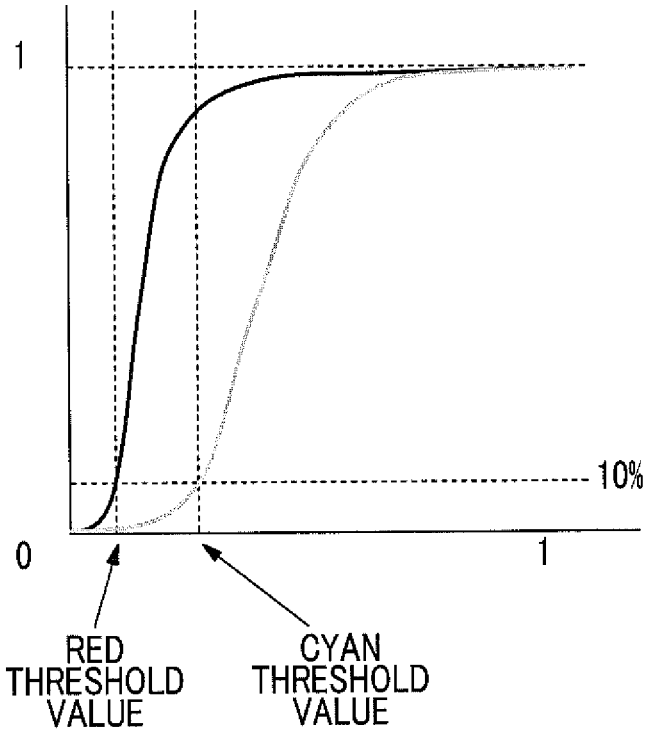
FIG. 10 is a diagram illustrating a definition of a threshold value in an example.
FIG. 11 is a table illustrating an example of a threshold value.

In the present example, as shown in FIG. 10, a voltage and a time in which a color density varies by 10% or more are defined as threshold values. In addition, other references, for example, an optical reflectance, a particle amount, color coordinates, brightness, chroma, and the like may be used as threshold values. Further, a reference value is not limited to 10%, but is set to a value or more at which a variation is able to be recognized at least with the human eye.

In addition, threshold characteristics of the respective particles are defined using a matrix of a voltage and a time, for example, as shown in FIG. 11. In the present example, as shown in FIG. 11, in a case where an applied voltage is 30 V, a threshold value of the red particles is 21 ms and a threshold value of the cyan particles is 72 ms, in a case where an applied voltage is 25 V, a threshold value of the red particles is 28 ms and a threshold value of the cyan particles is 130 ms, in a case where an applied voltage is 20 V, a threshold value of the red particles is 41 ms and a threshold value of the cyan particles is 215 ms, in a case where an applied voltage is 15 V, a threshold value of the red particles is 85 ms and a threshold value of the cyan particles is 380 ms, and, in a case where an applied voltage is 10 V, a threshold value of the red particles is 220 ms and a threshold value of the cyan particles is 835 ms.

In the present example, since a potential of the common electrode is set to be displaced in synchronization with starting of a frame, deviation of the scanning timing is about one frame at most. In addition, the deviation of the scanning timing depends on a synchronization timing of a potential of the common electrode and a potential of the pixel electrode. For example, when synchronization with starting or finishing of a frame is performed, deviation of about one frame occurs, and when synchronization with the middle of the frame is performed, deviation of about 0.5 frame occurs.

FIRST EXAMPLE

Here, a first example using the image display medium will be described.

In the first example, first, −15 V is applied to the common electrode as the voltage V1 and +15 V is applied to the pixel electrode as the voltage V2 for one second, in the first step.

Successively, in the second step, +15 V is applied to the common electrode as the voltage V3 and −15 V is applied to the pixel electrode as the voltage V4 for one second, and, thereafter, +15 V which is the voltage V3 is applied to the pixel electrode so as to set the common electrode and the pixel electrode to the same potential.

Next, in the third step, the voltage V5 is applied to the common electrode and the pixel electrode for one second as a voltage at which a particle concentration does not vary, as shown in FIG. 12A.

In the above-described driving, a color density of the display substrate 1 is measured for each of a voltage value of the voltage V5, a frame time of the third step, the time when the second step finishes, and the time after transition to the third step is performed, and the maximum density variation amount in the display substrate is derived.

In addition, FIG. 12B shows determination results of whether or not the variation amount is equal to or less than the variation amount 10% used as a reference when a threshold value is derived. In FIG. 12B, a case where the variation amount is equal to or less than 10% is indicated by "O", and a case where the variation amount is greater than 10% is indicated by "X".

As shown in FIG. 12B, during transition from the second step to the third step, if an unnecessary electric field generated due to deviation of the scanning timing is equal to or less than the threshold value of the red particles having a low threshold value, an unnecessary density variation is suppressed.

SECOND EXAMPLE

Next, a second example using the image display medium will be described.

In the second example, in the first step, −15 V is applied to the common electrode as the voltage V1 and +15 V is applied to the pixel electrode as the voltage V2 for one second, and, thereafter, −15 V which is the voltage V1 is applied to the pixel electrode so as to set the common electrode and the pixel electrode to the same potential.

Next, in the second step, the voltage V3 is applied to the common electrode and the pixel electrode for one second as a voltage at which a particle concentration does not vary, as shown in FIG. 13A.

In the above-described driving, a color density of the display substrate 1 is measured for each of a voltage value of the voltage V3, a frame time of the second step, the time when the first step finishes, and the time after transition to the second step is performed, and the maximum density variation amount in the display substrate is derived.

In addition, FIG. 13B shows determination results of whether or not the variation amount is equal to or less than the variation amount 10% used as a reference when a threshold value is derived. In FIG. 13B, a case where the variation amount is equal to or less than 10% is indicated by "O", and a case where the variation amount is greater than 10% is indicated by "X".

Here, the cyan particles which are particles having a high threshold value are driven in the second step, but if the particles having a high threshold value are driven, the particles having a lower threshold value than the particles are also driven together. Since the red particles which are particles having a low threshold value are preferably driven in the third step, it is preferable that the density does not vary in relation to the cyan particles which are particles having a high threshold value in the transition from the first step to the second step. Therefore, in a case where transition occurs from the first step to the second step, when an unnecessary electric field generated due to deviation of the scanning timing is equal to or less than the threshold value of the cyan particles having a high threshold value, an unnecessary density variation is suppressed.

More preferably, if an unnecessary electric field is set to be equal to or less than the threshold value of the red particles having a low threshold value, and the density is not made to vary in relation to the red particles, more stable display is performed.

THIRD EXAMPLE

Next, a third example using the image display medium of the present example will be described.

In the third example, in the first step, −15 V is applied to the common electrode as the voltage V1 and +15 V is applied to the pixel electrode as the voltage V2 for one second.

Successively, in the second step, +15 V is applied to the common electrode as the voltage V3 and −15 V is applied to the pixel electrode as the voltage V4 for one second.

Next, in the third step, as shown in FIG. 14A, the voltage V5 is applied to the common electrode and +15 V is applied to the pixel electrode as the voltage V6 for one second, and, thereafter, the voltage V5 is applied to the pixel electrode so as to set the common electrode and the pixel electrode to the same potential.

Next, as a finish state, 0 V which is a reference voltage is applied to the common electrode and the pixel electrode.

In the above-described driving, a color density of the display substrate 1 is measured for each of a voltage value of the voltage V5, a frame time of the finish state, the time when the third step finishes, and the finish state, and the maximum density variation amount in the display substrate is derived.

In addition, FIG. 14B shows determination results of whether or not the variation amount is equal to or less than the variation amount 10% used as a reference when a threshold value is derived. In FIG. 14B, a case where the variation amount is equal to or less than 10% is indicated by "O", and a case where the variation amount is greater than 10% is indicated by "X".

As shown in FIG. 14B, during transition from the third step to the finish state, if an unnecessary electric field generated due to deviation of the scanning timing is equal to or less than the threshold value of the red particles having a low threshold value, an unnecessary density variation is suppressed.

FOURTH EXAMPLE

Next, a fourth example using the image display medium of the present example will be described.

In the fourth example, one frame is added between the second step and the third step in the first example as a frame for setting the common electrode and the pixel electrode to 0 V (the above-described intermediate potential).

In addition, in the first step, −15 V is applied to the common electrode as the voltage V1 and +15 V is applied to the pixel electrode as the voltage V2 for one second.

Successively, in the second step, +15 V is applied to the common electrode as the voltage V3 and −15 V is applied to the pixel electrode as the voltage V4 for one second, and, thereafter, +15 V which is the voltage V3 is applied to the pixel electrode so as to set the common electrode and the pixel electrode to the same potential.

Next, one frame is provided as an intermediate frame for setting the common electrode and the pixel electrode to 0 V.

Next, in the third step, the voltage V5 is applied to the common electrode and the pixel electrode for one second as a voltage at which a particle concentration does not vary, as shown in FIG. 15A.

In the above-described driving, a color density of the display substrate 1 is measured for each of a voltage value of the voltage V3, a voltage value of the voltage V5, an intermediate frame time, a frame time of the third step, the time when the second step finishes, and the time after transition to the third step, and the maximum density variation amount in the display substrate is derived.

In addition, FIG. 15B shows determination results of whether or not the variation amount is equal to or less than the variation amount 10% used as a reference when a threshold value is derived. In FIG. 15B, a case where the variation amount is equal to or less than 10% is indicated by "O", and a case where the variation amount is greater than 10% is indicated by "X".

In the fourth example, it is not preferable that an unnecessary electric field during transition from the second step to the intermediate frame and an unnecessary electric field during transition from the intermediate frame to the third step be determined separately from each other, and it is necessary to determine both of the two together.

Specifically, in a case where an unnecessary electric field during transition from the second step to the intermediate frame and an unnecessary electric field during transition from the intermediate frame to the third step are continuously applied, the unnecessary electric fields are required to be equal to or less than a threshold value of the particles.

In the fourth example, as shown in FIG. 15B, during transition from the second step to the third step, if an unnecessary electric field generated due to deviation of the scanning timing is equal to or less than the threshold value of the red particles having a low threshold value, an unnecessary density variation is suppressed.

In addition, although, in the above-described exemplary embodiment and examples, a description has been made of a case of two kinds of particles which are charged and have threshold characteristics, the particles are not limited to two kinds, and three or more kinds may be used. For example, in a case of three kinds, driving is performed through a first step in which reset driving is performed, a second step in which a voltage for controlling a particle concentration of particles having the largest threshold characteristics is applied, a third step in which a voltage for controlling a particle concentration of particles having the second largest threshold characteristics is applied, and a fourth step in which a voltage for controlling a particle concentration of particles having the smallest threshold characteristics is applied. In addition, preferably, a deviation time of the scanning timing due to the active matrix driving during transition to each step is performed and a potential difference between the substrates at that time are equal to or less than threshold characteristics. In this case, at least the deviation time during transition to the final step and a potential difference between a pair of substrates in the deviation time may be equal to or less than threshold characteristics of particles which are moved in the final step; the deviation time during transition to each step and a potential difference between a pair of substrates in the deviation time may be equal to or less than threshold characteristics of particles of which a particle concentration is controlled in a step before the transition; the deviation time during transition to each step and a potential difference between a pair of substrates in the deviation time may be equal to or less than threshold characteristics of particles of which a particle concentration is controlled in a step after the transition; and the deviation time during transition to each step and a potential difference between a pair of substrates in the deviation time may be equal to or less than threshold characteristics of particles of which a particle concentration is controlled in a step subsequent to a step after the transition. Thus, a movement of the particles due to an unintended voltage before applying a voltage for controlling the particles is suppressed.

Further, although, in the above-described exemplary embodiment and examples, a description has been made of an example in which plural types of particle groups are charged to the same polarity, the particle groups are not limited to being charged to the same polarity and may be charged to opposite polarities, and there is no limitation on polarities.

In addition, the processes performed by the controller 40 in the above-described exemplary embodiment may be realized in hardware, or may be realized by executing a program of software. Further, the program may be stored in various storage media and be distributed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A driving device of an image display medium comprising:

a voltage application unit that varies a voltage applied to a common electrode provided in one of a pair of substrates, and applies a voltage to a pixel electrode provided in the other substrate through active matrix driving, with respect to the image display medium including a plurality of kinds of particles which are sealed between the pair of substrates at least one of which is transparent, are colored in different colors for each kind, and have different threshold characteristics of a voltage required to leave the substrate from a state of being adhered to the substrate for each kind, and displaying an image based on image information; and a controller that controls the voltage application unit such that a voltage is applied between the pair of substrates through a plurality of steps in which voltages for controlling a particle concentration are sequentially applied between the pair of substrates in order in which the threshold characteristics are large, and controls the voltage application unit such that a deviation time generated due to deviation of a scanning timing and a potential difference between the pair of substrates during transition between the steps is gradually decreased and is equal to or less than predefined threshold characteristics of the particles to suppress unnecessary concentration variation of the particles, such that the particles do not move when the potential difference between the pair of substrates in the deviation time is equal to or less than the predefined threshold characteristics of the particles.

2. The driving device of the image display medium according to claim 1, wherein the controller controls the voltage application unit such that the deviation time during transition to at least a final step of the plurality of steps and a potential difference between the pair of substrates in the deviation time are equal to or less than the threshold characteristics of particles of which a particle concentration is controlled in the final step.

3. The driving device of the image display medium according to claim 1, wherein the controller controls the voltage application unit such that the deviation time during transition to each step of the plurality of steps and a potential difference between the pair of substrates in the deviation time are equal to or less than the threshold characteristics of particles of which a particle concentration is controlled in a step before the transition.

4. The driving device of the image display medium according to claim 1, wherein the controller controls the voltage application unit such that the deviation time during transition to each step of the plurality of steps and a potential difference between the pair of substrates in the deviation time are equal to or less than the threshold characteristics of particles of which a particle concentration is controlled in a step after the transition.

5. The driving device of the image display medium according to claim 1, wherein the controller controls the voltage application unit such that the deviation time during transition to each step of the plurality of steps and a potential difference between the pair of substrates in the deviation time are equal to or less than the threshold characteristics of particles of which a particle concentration is controlled in a step subsequent to a step after the transition.

6. The driving device of the image display medium according to claim 1, wherein, when the image display medium includes two kinds of particles, the controller controls the voltage application unit such that a voltage is applied between the pair of substrates through a first step in which reset driving is performed, a second step in which a voltage for controlling a particle concentration of the particles having the larger threshold characteristics is applied, and a third step in which a voltage for controlling a particle concentration of the particles having the smaller threshold characteristics is applied, and controls the voltage application unit such that a deviation time of the scanning timing generated due to the active matrix driving at least during transition from the second step to the third step and a potential difference between the pair of substrates in the deviation time are equal to or less than the smaller threshold characteristics.

7. The driving device of the image display medium according to claim 5, wherein, when the image display medium includes two kinds of particles, the controller controls the voltage application unit such that a voltage is applied between the pair of substrates through a first step in which reset driving is performed, a second step in which a voltage for controlling a particle concentration of the particles having the larger threshold characteristics is applied, and a third step in which a voltage for controlling a particle concentration of the particles having the smaller threshold characteristics is applied, and controls the voltage application unit such that a deviation time of the scanning timing generated due to the active matrix driving at least during transition from the first step to the second step and a potential difference between the pair of substrates in the deviation time are equal to or less than the larger threshold characteristics.

8. The driving device of the image display medium according to claim 1, wherein, when the image display medium includes two kinds of particles, the controller controls the voltage application unit such that a voltage is applied between the pair of substrates through a first step in which reset driving is performed, a second step in which a voltage for controlling a particle concentration of the particles having the larger threshold characteristics is applied, and a third step in which a voltage for controlling a particle concentration of the particles having the smaller threshold characteristics is applied, and controls the voltage application unit such that a deviation time of the scanning timing generated due to the active matrix driving at least during transition from the first step to the second step and a potential difference between the pair of substrates in the deviation time are equal to or less than the smaller threshold characteristics.

9. The driving device of the image display medium according to claim 1, wherein the controller further controls the voltage application unit such that a potential difference between the substrates during transition to each step is set to an intermediate potential of the potential difference between the respective steps of the plurality of steps.

10. The driving device of the image display medium according to claim 2, wherein the controller further controls the voltage application unit such that a potential difference between the substrates during transition to each step is set to an intermediate potential of the potential difference between the respective steps of the plurality of steps.

11. The driving device of the image display medium according to claim 3, wherein the controller further controls the voltage application unit such that a potential difference between the substrates during transition to each step is set to an intermediate potential of the potential difference between the respective steps of the plurality of steps.

12. The driving device of the image display medium according to claim 4, wherein the controller further controls the voltage application unit such that a potential difference between the substrates during transition to each step is set to an intermediate potential of the potential difference between the respective steps of the plurality of steps.

13. The driving device of the image display medium according to claim 5, wherein the controller further controls the voltage application unit such that a potential difference between the substrates during transition to each step is set to an intermediate potential of the potential difference between the respective steps of the plurality of steps.

14. The driving device of the image display medium according to claim 6, wherein the controller further controls the voltage application unit such that a potential difference between the substrates during transition to each step is set to an intermediate potential of the potential difference between the respective steps of the plurality of steps.

15. The driving device of the image display medium according to claim 7, wherein the controller further controls the voltage application unit such that a potential difference between the substrates during transition to each step is set to an intermediate potential of the potential difference between the respective steps of the plurality of steps.

16. The driving device of the image display medium according to claim 1, wherein the controller further controls the voltage application unit such that a predefined reference voltage is applied between the pair of substrates after a final step, and further controls the voltage application unit such that a deviation time of the scanning timing generated due to the active matrix driving during transition to the reference voltage and a potential difference between the pair of substrates in the deviation time are equal to or less than the threshold characteristics of particles of which a particle concentration is controlled in the final step.

17. The driving device of the image display medium according to claim 1, wherein the controller controls the voltage application unit such that a frame time of each step gradually decreases.

18. An image display apparatus comprising:

an image display medium that includes a pair of substrates at least one of which is transparent, a common electrode provided in one of the pair of substrates, a pixel electrode provided in the other substrate, and a plurality of kinds of particles which are sealed between the pair of substrates, are colored in different colors for each kind, and have different threshold characteristics of a voltage required to leave the substrate from a state of being adhered to the substrate for each kind, and that displays an image based on image information; and the driving device of the image display medium according to claim 1.

19. A non-transitory computer readable medium storing a driving program causing a computer to function as the controller of the driving device of the image display medium according to claim 1.

* * * * *